United States Patent [19]

Mancusi Jr.

[11] Patent Number: 4,855,880

[45] Date of Patent: Aug. 8, 1989

[54] ELECTRICALLY ENHANCED ARTIFICIAL TREE

[76] Inventor: Joseph J. Mancusi Jr., 25 Port Tack, Hilton Head Island, S.C. 29928

[21] Appl. No.: 126,034

[22] Filed: Nov. 10, 1987

[51] Int. Cl.[4] ..... A47G 33/06

[52] U.S. Cl. ..... 362/123; 362/806; 428/19

[58] Field of Search ..... 428/20, 18, 19; 362/123, 806; 439/168, 340

[56] References Cited

U.S. PATENT DOCUMENTS

| | | | |
|---|---|---|---|
| 2,188,529 | 1/1940 | Corina | 362/123 |
| 3,603,780 | 9/1971 | Lu | 428/20 X |
| 3,617,732 | 11/1971 | Fisher | 362/123 X |
| 3,735,117 | 5/1973 | Hunt | 362/123 |
| 3,970,834 | 7/1976 | Smith | 362/123 |
| 3,985,924 | 10/1976 | Pritza | 428/20 X |
| 4,072,857 | 2/1978 | DeVicaris | 362/123 |
| 4,156,892 | 5/1979 | Fisher | 428/20 X |
| 4,161,768 | 7/1979 | Gauthier et al. | 428/20 X |
| 4,573,102 | 2/1986 | Norwood | 362/123 |

*Primary Examiner*—Henry F. Epstein
*Attorney, Agent, or Firm*—Joseph B. Taphorn

[57] ABSTRACT

An electrically illuminated artificial Christmas tree, eliminating the need for a transformer while providing all of the advantages of low voltage distribution and isolated light failure, connects groups of seed lights in parallel across sets of two wires which are respectively connected in series to wires of different sets, enabling use of an inexpensive power source for establishing suitable levels of low voltage operation.

5 Claims, 2 Drawing Sheets

ELECTRICALLY ENHANCED ARTIFICIAL TREE

BACKGROUND OF THE INVENTION

1. Field of the Invention

This invention relates to artificial tress, and more particularly, to an electrically illuminated artificial Christmas tree wherein groups of seed lights are connected in parallel across sets of two wires which are respectively connected in series to wires of different sets, to eliminate the need for a transformer and allow the use of an inexpensive selenium rectifier control for establishing a suitable level of voltage operation for the seed lights.

2. Description of the Prior Art

Electrically illuminated artificial holiday trees having integrated circuits are well known. See U.S. Pat. Nos. 4,573,102; 3,970,834; 3,735,117; 3,617,732; 3,603,780; and 2,188,529.

SUMMARY OF THE INVENTION

1. An object of the present invention is to eliminate the need for a transformer as a current source for electrically illuminated artificial trees, in order to reduce the cost thereof.

Another object of the invention is to enable the use of inexpensive devices such as selenium rectifiers to control the voltage applied to the illumination means.

Still another object of invention is to provide an electrically illuminated artificial tree that is easy of assemblage.

Still another object of invention is to provide an electrically illuminated artificial tree that is easy of manufacture.

A further object of the invention is to provide an electrically illuminated artificial Christmas tree that can be conveniently stored from Christmas season to Christmas season, and used again and again.

In accordance with the present invention, an electrically illuminated artificial tree having branches, incorporates among the various branches, sets of circuits having lights arranged in parallel therein, and interconnects the respective wires of the parallel circuits in series with the different parallel circuits. A selenium rectifier in series with the serially connected different wires of the parallel circuits provides the current and enables voltage regulation thereof.

BRIEF DESCRIPTION OF THE DRAWINGS

The above and other objects, features, and advantages of the invention will be apparent from a consideration of the following description of an illustrative embodiment thereof, when taken together with the accompanying drawings wherein.

DETAILED DESCRIPTION OF THE PREFERRED EMBODIMENT

Figure 1:
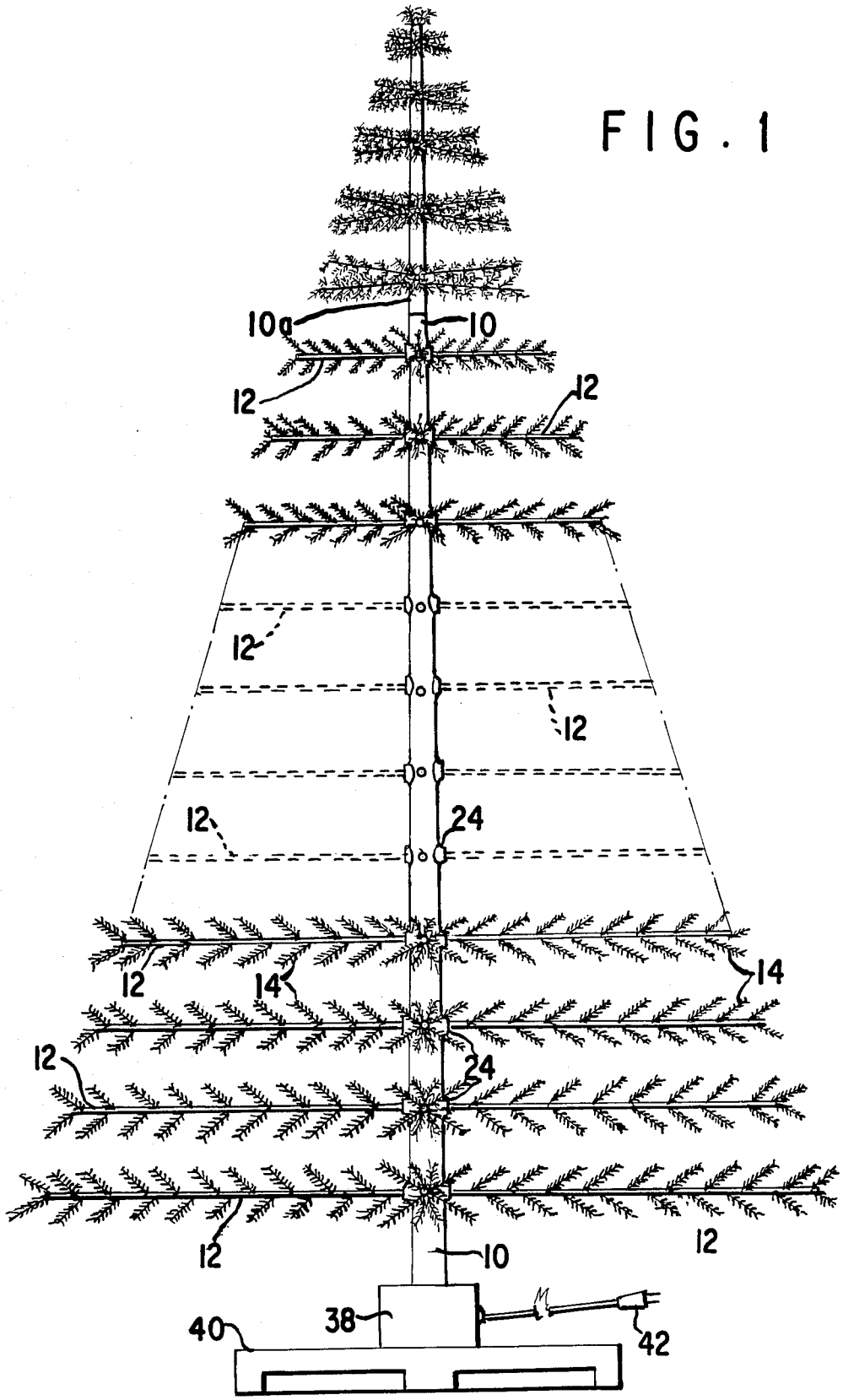
FIG. 1 is a diagrammatic front view of an assembled artificial Christmas tree incorporating the invention.

Referring now in detail to the drawings and particularly FIG. 1 thereof, there is shown an electrically illuminated artificial Christmas tree having a hollow plastic trunk 10 and radially extending, hollow plastic limbs 12 spaced in layers with respect to the tree trunk 10 and circumferentially with respect to each in every layer. Each limb 12 has many hollow plastic branches 14 (FIG. 2) formed integrally therewith and extending laterally outwards and bearing seed lights or lamps 16 via holders 18 suitably molded in the branches 14 and establishing electrical connection of the lights 16 with wires 20 (FIG. 5) in the branches 14 and limbs 12. The seed lights 16 are connected in parallel across the wires 20 so that extinguishment of one does not extinguish the others or result in significant voltage changes within the light circuits.

Figures 2, 3, 4, 5:
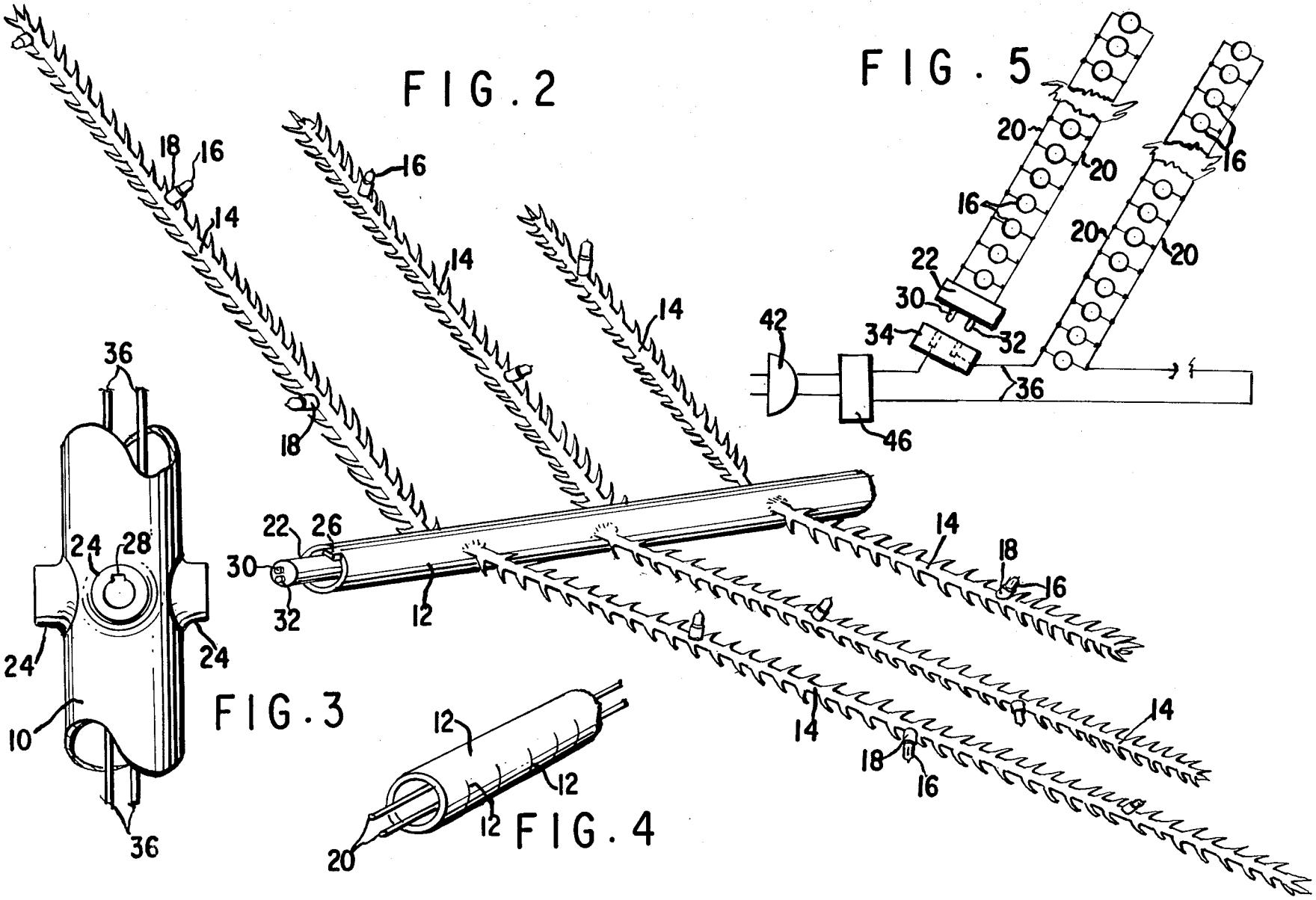
FIG. 2 is a diagrammatic view of a typical limb, and branches, of the artificial Christmas tree, including its physical and electrical connection mechanisms.
FIG. 3 is a frontal view, partially in section, showing a portion of the artificial Christmas tree trunk, including physical and electrical connection mechanisms.
FIG. 4 is a side view of a portion of a limb 12 showing details of its construction.
FIG. 5 is a diagrammatic view of a portion of the electrical circuit and showing principles of the invention.

Limbs 12 are attached physically and electrically to the trunk 10 via wiring terminal plugs 22 (FIG. 2) fitted within the ends of the hollow limbs and adapted to be received within limb receptacles 24 (FIG. 3) formed integral with the trunk 10. A key 26 (FIG. 2) on the end of each limb 12 is received within a slot 28 in the corresponding limb receptacle to anchor the limb 12 in proper angularity. The plug 22 bears two male electrical terminals 30 and 32 intended to be received in a female electrical socket 34 (FIG. 5) to establish in series electrical connections with the wiring in adjacent limbs or layers of limbs via wires 36 in trunk 10 (FIG. 3). Of course, with the smaller limbs near the top, the lights of two or more limbs may be mounted in one parallel circuit.

The lower end of the trunk 10 is shown as inserted in a rectifier control box 38 setting on a stand 40 for providing vertical stability. A 120 volt cord and plug 42 is shown as emanating from the rectifier control box 38.

The trunk 10 may be formed with a separable upper portion **10*a* constituting the supporting structure for the upper portion of the tree which is generally constructed as the lower portion is except for reduced proportions. The physical and electrical connections between the trunk 10 and the trunk portion 10*a* may be of the same nature as between a limb 12 and trunk 10 earlier described. Similar physical and electrical connections may be made between the trunk 10 and the rectifier control box 38**.

A tree as described above facilitates modular construction and compact packaging by manufacturers for ease of shipment, storage, and consumer marketing. It is easy to install. It is also easy to disassemble and store by the end user between Christmas seasons. But for those who do not wish to disassemble, limbs 12 (FIG. 4) and branches 14 are formed with cuts 44 on their underneath sides to permit upward and inward folding of the limbs and branches about the trunk 10 to form a compact storage arrangement.

It will also be appreciated the limbs 12 and branches 14 need not be hollow, but may be solid with the conductors 20 molded therein. Also that the limbs 12 may be lighter but the conductors heavier to assist in performing the limb beam function. Additionally, such conductors may be tempered to allow the flexure needed for storage folding without producing permanent set or distortion.

A feature of the invention resides in the electrical circuitry. As shown in FIG. 5, sets of forty seed lights 16 are connected in parallel across a set of limb and branch wires 20. One of these wires 20 is connected in series with one of the wires of an adjacent set of parallel wires connecting forty lights in parallel. The other of this second set of parallel wires is connected in series with one of wires of another adjacent set of parallel wires connecting forty lights in parallel. Typically twelve sets of parallel circuits each connecting forty seed lights in parallel would be incorporated in the artificial Christmas tree, with the other wires of the first set of parallel wires and the twelfth set of parallel wires (the exterior set) (set 2 through 11 being considered the interior set) being connected across an inexpensive selenium rectifier 46 (FIG. 5) in the control box 38 (FIG. 1). Such a selenium rectifier 46 may be adjusted to vary the voltage level determining the brightness level of the seed lights 16.

In manufacturing, the improved tree of this invention would be constructed in parts, and the parts packaged in a compact container. The end user will open the package, place the stand 40 on the floor, secure the rectifier control box 38 to the stand, and place the lower end of the trunk 10 in the control box 38, thereby also establishing electrical connection between the trunk wires 36 and the selenium rectifier 46. The various limbs 12 would be attached to the tree by inserting their wiring terminal plugs 22 in the receptacles 24 of the trunk 10, thereby also establishing electrical connections for the lights 16 on the limb's branches 14. Finally, the upper portion of the tree would be put in place physically and electrically by connecting the lower end of the trunk portion 10*a* with the upper end of the trunk 10. All of the seed lights 16 would now be connected in groups of forty between the wires 20 of various sets of parallel wires, which wires 20 are each connected in series with a wire of a different electrically adjacent set of parallel wires or one of the contacts of the selenium rectifier 46, through the trunk wires 36. If the 120 volt cord and plug 42 are now inserted into an electrical outlet, and the selenium rectifier 46 switched on, the seed lights 16 will light up to brighten the Christmas tree in traditional fashion.

After the Christmas season, the tree may be disassembled for storage by reversing the procedure set forth above. Alternatively only the top portion of the tree may be separated by removing the lower end of the trunk portion 10*a* from the upper end of the trunk 10, and the main portion of the tree separated from the rectifier control box 38 and the stand 40 by pulling out the lower end of the trunk 16 from the rectifier control box 38. The limbs 12 and branches 14 might then be folded upward and inward to form a compact somewhat cylindrical arrangement which can be conveniently sorted. The cuts 44 in the limbs 12 and 14 facilitate the upward and inward bending of the limbs and branches. Placing the compact cylindrical arrangement in a plastic bag would protect the tree from dust and other problems during the non-Christmas season.

While the invention has been described with reference to a particular embodiment, it should be realized that the description is illustrative, and that the invention can be incorporated in many other embodiments. Various modifications can be made without departing from the spirit of the invention, and it is intended that the scope of the invention only be limited by the appended claims.

What is claimed is:

1. An electrified artificial Christmas tree having branches, lamps on the various branches, and sets of two wires, groups of said lamps being electrically connected across the two wires of respective sets, and each of the wires of each interior set being electrically connected in series with a wire of different other sets.

2. An electrified artificial Christmas tree according to claim 1, wherein the branches are attached to limbs which are readily attachable to the trunk of the tree.

3. An electrified artificial Christmas tree according to claim 1 or 2, wherein the limbs and branches are upwardly and inwardly flexible.

4. An electrified artificial Christmas tree according to claim 1, wherein a power source is connected to the wires of the exterior sets not connected in series with a wire of a different set.

5. Electrical wiring for illuminating a Christmas tree or the like, comprising holders for lamps, sets of wires across which respective groups of said lamp holders are electrically connected in parallel, the wires of each set being respectively electrically connected in series with wires of the different adjacent sets except for the end sets wherein the other wires are adapted to be connected to a power supply.

* * * * *